United States Patent [19]

Steinkamp

[11] Patent Number: 4,949,473

[45] Date of Patent: Aug. 21, 1990

[54] FREEZE DRYING APPARATUS WITH ADDITIONAL CONDENSATION SURFACE AND REFRIGERATION SOURCE

[75] Inventor: Heinrich Steinkamp, Cologne, Fed. Rep. of Germany

[73] Assignee: Leybold Aktiengesellschaft, Köhn, Fed. Rep. of Germany

[21] Appl. No.: 226,536

[22] Filed: Jul. 29, 1988

[30] Foreign Application Priority Data

Jul. 29, 1987 [EP] European Pat. Off. ..... 87110955

[51] Int. Cl.[5] ..... F26B 13/30

[52] U.S. Cl. ..... 34/92; 34/5; 62/332

[58] Field of Search ..... 34/5, 15, 92; 62/332, 62/333, 514, 45, 54

[56] References Cited

U.S. PATENT DOCUMENTS

| | | | |
|---|---|---|---|
| 2,453,033 | 11/1948 | Patterson . | |
| 3,191,395 | 6/1965 | Maher et al. | 62/54 |
| 3,230,633 | 1/1966 | Hamilton | 34/92 X |
| 3,385,073 | 5/1968 | Snelling | 62/45 |
| 3,648,379 | 3/1972 | Mercer et al. . | |
| 4,060,400 | 11/1977 | Williams . | |

FOREIGN PATENT DOCUMENTS

| | | | |
|---|---|---|---|
| 3107241 | 9/1982 | Fed. Rep. of Germany | 34/5 |
| 784430 | 4/1934 | France . | |
| 1586349 | 1/1970 | France . | |
| 2461213 | 7/1988 | France . | |
| 552821 | 12/1941 | United Kingdom . | |
| 1008814 | 2/1962 | United Kingdom . | |
| 1024866 | 2/1962 | United Kingdom . | |

*Primary Examiner*—Henry A. Bennet
*Assistant Examiner*—John Sollecito
*Attorney, Agent, or Firm*—Spencer & Frank

[57] ABSTRACT

A freeze drying apparatus includes a vacuum chamber, an evacuation system, and an additional condensation surface which may serve as a fail-safe condensation surface. The additional condensation surface is connected by way of a valve with a reservoir container containing a low boiling point coolant, such as liquid nitrogen. If, due to a malfunction, the pumping power of the evacuation system fails, the valve is opened so that the additional condensation surface takes over the pumping work for the commodity charge positioned in the vacuum chamber. The additional condensation surface may be positioned in a condenser of the evacuation system, in the vacuum chamber, or in a separate chamber connected to the vacuum chamber.

6 Claims, 1 Drawing Sheet

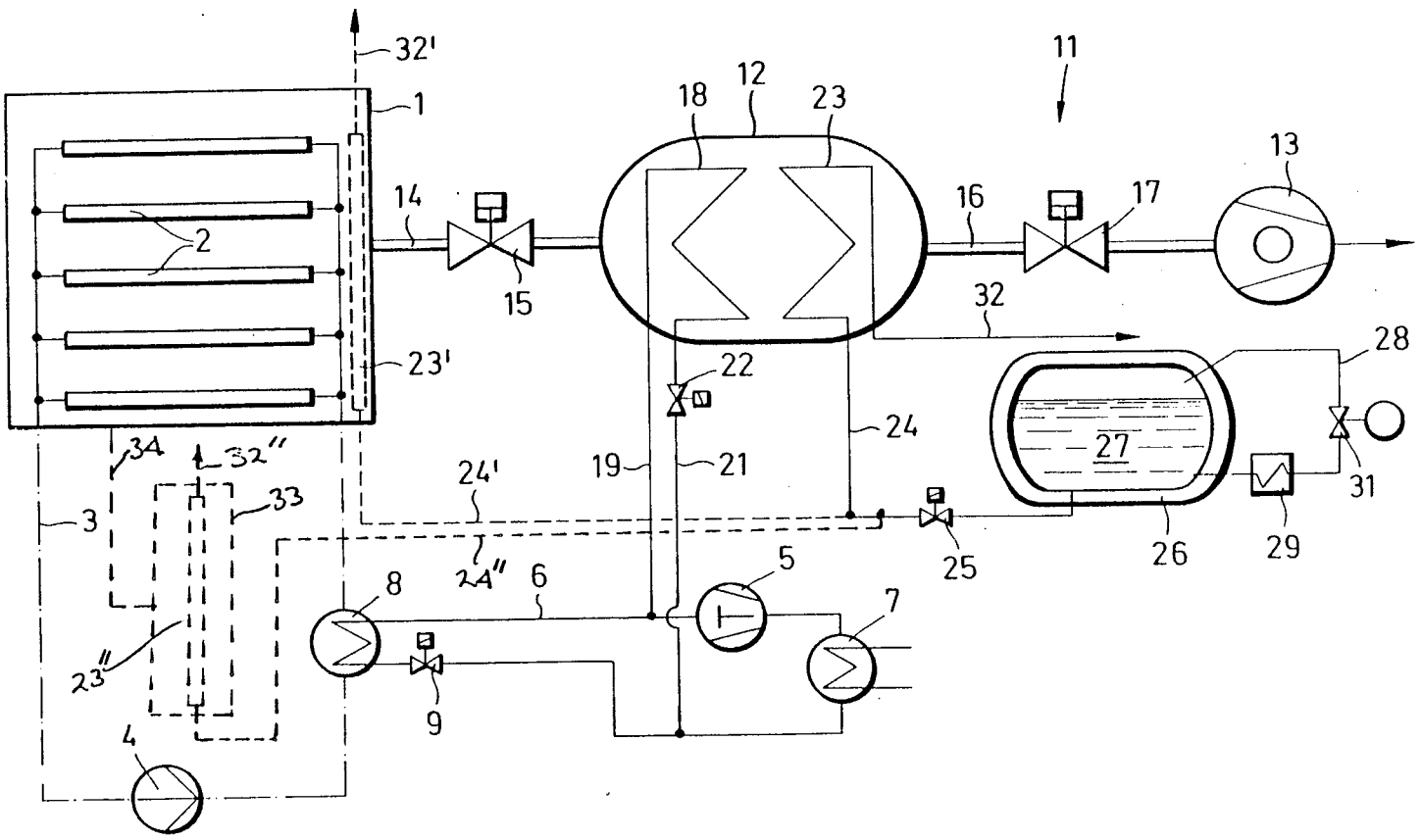
11
13
17
16
32
28
31
29
26
27
25
24
23
12
18
22
21
19
15
14
23'
32'
1
2
24'
24''
6
9
8
7
5
33
32''
34
3
23''
4

FREEZE DRYING APPARATUS WITH ADDITIONAL CONDENSATION SURFACE AND REFRIGERATION SOURCE

BACKGROUND OF THE INVENTION

1. Field of the Invention

The present invention relates to a freeze drying apparatus including à vacuum chamber and an evacuation system.

2. Background of the Art

Freeze drying is a technique for conserving temperature sensitive commodities whose characteristics are to be retained. Freeze drying is used primarily in pharmacology, biology and medicine.

The usual freeze drying process includes a primary drying process and a supplemental drying process which takes place approximately as follows. After freezing a commodity which contains water, the water now present as ice is sublimed under vacuum, typically at approximately $10^{-1}$ mbar. After this primary drying process, a supplemental drying process takes place during which adsorptively bound moisture is removed to realize an extremely low residual moisture content. During this subsequent supplemental drying, the product is heated within permissible temperature limits determined by the nature of the commodity. The pressure at which the supplemental drying takes place lies at about $10^{-3}$ mbar. Examples for permissible temperatures commodities include 40° C. for biological products.

Since freeze drying is performed in charges, it is desirable to make the individual charges as large as possible and the monetary value per charge is thus correspondingly high. At present it has become quite customary to operate with charges whose value lies over 100,000 German Marks, i.e., approximately $175,000. The loss of a charge due to an apparatus malfunction thus leads to significant monetary losses.

Apparatus malfunctions that endanger a commodity charge include malfunctioning of the compressor refrigeration machines which supply coolant to the commodity support surfaces in the vacuum chamber and the condensation surfaces in the condenser. Such malfunctioning may involve a defect in the coolant compressor itself or a loss of coolant from the refrigeration circuit, complete or partial loss of current, loss of cooling of the liquefiers in the coolant circuit of the coolant compressors if, for example, the water supply is lost, or loss of system control.

All of these possible malfunctions result in the loss of compressor cooling and thus loss of pumping power in the evacuation system. Since it is necessary to supply the energy required for the sublimation of the water in the commodity to be dried in the form of heat, loss of the evacuation system results in the commodity heating up since the water vapor escaping from the commodity is no longer pumped away. This, together with a rise in pressure in the freeze drying chamber, causes the commodity to begin to thaw. This circumstance results in a loss of quality, particularly for highly sensitive medicinal products, and the possible loss of the entire commodity charge.

SUMMARY OF THE INVENTION

It is an object of the present invention to provide a freeze drying apparatus of the above-mentioned type in which the product charges are no longer endangered by apparatus malfunctions of the above-described or similar type.

According to the invention, this is accomplished by equipping the apparatus with an additional condensation means which may serve as a fail-safe condensation means, i.e., an additional condensation means including an additional condensation surface which is connected, by way of a valve, with a reservoir container containing a low boiling point coolant. In case of a malfunction, the valve between the additional condensation surface, which is positioned, for example, in the condenser, and the reservoir container is opened so that coolant flows into the additional condensation surface to cool the condensation surface. The additional condensation surface thus acts as a pump in this freeze drying apparatus. Advantageously therefore, the vacuum in the freeze drying chamber remains in effect independently of the operating medium so that the danger of thawing of the product, whether slight or complete, does not exist. The additional condensation surface may be accommodated in the freeze drying chamber, in the condenser which is customarily connected to the freeze drying chamber or in a separate chamber connected to the freeze drying chamber.

The invention thus provides freeze drying apparatus, including a vacuum chamber; an evacuation system; a reservoir container containing a coolant which is a liquid having a low boiling point; and an additional condensation surface which is connected to the reservoir container by a conduit including a first valve.

The invention additionally provides the method of operating a freeze drying apparatus comprising a vacuum chamber; an evacuation system; a reservoir container containing a coolant which is a liquid having a low boiling point; and an additional condensation means including an additional condensation surface, which additional condensation means is connected to a reservoir container by a conduit including a first valve, the method comprising cooling the an additional condensation surface with the coolant from the reservoir container in the event of a malfunction or loss of current.

BRIEF DESCRIPTION OF THE DRAWING

The sole drawing FIGURE is a schematic representation of the freeze drying apparatus according to the invention.

DESCRIPTION OF THE PREFERRED EMBODIMENTS

Further advantages and details of the invention will be described with reference to three embodiments that are illustrated schematically in the sole drawing FIGURE.

The freeze drying device shown in the drawing FIGURE includes a vacuum chamber 1 equipped with supporting surfaces 2 on which the commodity is disposed during the course of the freeze drying process to provide a freeze dried product. Customarily, supporting surfaces 2 are coolable as well as heatable. For this purpose, supporting surfaces 2 are equipped with cavities (not shown in detail) through which flows a tempering medium, for example, silicone oil. Tempering circuit 3 is shown in dot-dash lines. Tempering circuit 3 includes supporting plates 2 which are arranged parallel to one another and a delivery pump 4 for delivering tempering medium.

When the tempering circuit 3 is used for cooling the commodity, the tempering medium is cooled by coolant circuit 6. Compressor refrigeration machine 5 is part of coolant circuit 6, which customarily additionally includes a water cooled liquefier 7, a heat exchanger 8 and a valve 9, and through which circulates a coolant, for example, freon. Liquefier 7 is preferably water cooled. Heat exchanger 8 is also included in tempering circuit 3 and functions to exchange heat between the coolant and the tempering medium. Frequently, a plurality of compressor refrigeration machines 5 are used at this location, either as separate circuits to provide fail-safe operation or as a cascade to realize lower temperatures because of a cascade connection. The use of some other refrigeration machine, for example, an adsorption refrigeration machine, is also feasible.

When the tempering circuit 3 is used for heating the commodity, the tempering medium circulating therethrough is customarily heated by an electrical heating means in a manner not shown. This may alternately be accomplished, for example, by use of the heat dissipated from the refrigeration machines or by use of steam-heated heat exchangers.

Vacuum chamber 1 is connected to an evacuation system 11 composed of a condenser 12 and a vacuum pump 13 shown as a gas ballast pump. A valve 15 (third valve 15) is disposed in connecting line 14 between vacuum chamber 1 and condenser 12. Extending between condenser 12 and vacuum pump 13 is a conduit 16 equipped with a valve 17 (second valve 17).

Within condenser 12, one or a plurality of condensation surfaces 18 are provided which, during normal operation of the freeze drying apparatus, serve to remove water vapor from vacuum chamber 1. Customarily, condensation surfaces 18 are composed of coiled pipes (not shown) through which flow a coolant, for example, fluorochlorohydrocarbons. The exterior surfaces of these coiled pipes form the actual condensation surfaces 18 shown schematically. Compressor refrigeration machine 5 also serves to supply condensation surfaces 18 with coolant. Condensation surfaces 18 can be connected to the coolant circuit 6 by way of conduits 19 and 21 equipped with valve 22.

Condenser 12 includes an additional condensation means according to a first embodiment of the invention, which includes an additional condensation surface 23 which is connected via conduit 24, including a valve 25 (first valve 25), to a lower region of a reservoir container 26. Additional condensation surface 23 may be composed of a coiled pipe (not shown) through which flows a coolant. Reservoir container 26 contains a low boiling point coolant 27, for example, liquid nitrogen. A conduit 28, which connects with and opens into an upper region of reservoir container 26 above the coolant level, is also connected to the lower region of reservoir container 26. Conduit 28 includes an evaporator 29 and a pressure regulating valve 31. With the aid of these elements, a certain pressure, for example several bar, preferably 3 bar, can be maintained within reservoir container 26.

A second embodiment of the invention, in which an additional condensation surface 23′ is disposed within vacuum chamber 1, is shown by dashed lines. A conduit 24′ is connected with reservoir container 26 via valve 25 and is connected with and opens into condensation surface 23′ disposed adjacent supporting plates 2. The evaporated coolant is removed through conduit 32′, for example, into the atmosphere.

A third embodiment of the invention, in which an additional condensation surface 23″ is disposed in chamber 33, is shown by dashed lines. Chamber 33 is a separate chamber and is connected to vacuum chamber 1 by conduit 34. A conduit 24″ is connected with reservoir container 26 via valve 25 and is connected with and opens into condensation surface 23″ disposed in chamber 33. The evaporated coolant is removed through conduit 32″, for example, into the atmosphere.

The illustrated freeze drying apparatus operates as follows. After a sterilization process, the commodity to be processed is introduced into vacuum chamber 1 and is frozen. For this purpose, the tempering medium flowing in tempering circuit 3 is brought to an appropriately low temperature by means of compressor refrigeration machine 5. Valve 15 is closed during the freezing phase.

To perform the primary drying process, valves 15 and 17 are opened and the tempering medium flowing in tempering circuit 3 is heated. For this purpose, valve 9 in coolant circuit 6 is closed and the heating system (not shown) is put into operation.

Vacuum chamber 1 is evacuated to a pressure of about $10^{-1}$ mbar. In normal operation, condensation surfaces 18, which are cooled by means of compressor refrigeration machine 5, serve to remove the relatively large quantities of water vapor. Still-present, small quantities of permanent gases flow through condenser 12 and are removed with the aid of gas ballast pump 13.

If a malfunction occurs as previously described, the cooling system for condensation surfaces 18 is generally lost. The suction capability for water vapor decreases and relatively quickly reaches zero. The water vapor escaping from the commodity being processed is no longer removed from vacuum chamber 1. Since the tempering medium in tempering circuit 3 is warm during the primary and subsequent drying processes (room temperature or somewhat above), the commodity disposed on supporting plates 2 will be heated at once. If the commodity begins to thaw or thaws completely, there will often be a loss of quality or even a change which makes the product unusable.

In order to be able to maintain the water pumping capability of condenser 12 independently of the operating media, i.e., independently of the media, such as current, water and the like, required for normal operation of the freeze drying apparatus, an additional condensation means comprised of an additional condensation surface 23 is provided in condenser 12 according to the first embodiment of the invention, which first embodiment is the most preferred embodiment, or alternate location according to the second or third embodiments as previously described. By opening valve 25, coolant 27 having a low boiling point, such as liquid nitrogen, enters from the bottom into the coiled pipe forming additional condensation surface 23 and evaporates there, thus cooling additional condensation surface 23 very quickly to relatively low temperatures. The evaporated coolant is removed through conduit 32, for example, into the atmosphere. Additional condensation surface 23 is caused to become active before the water vapor suction capability of condensation surfaces 18 has decreased to an undesirable degree. Thus, the water vapor suction capability of condenser 12 remains in effect independently of the operating media until all of the coolant in reservoir container 26 is used up.

With suitable selection of the magnitude of the supply of coolant 27, emergency cooling can be maintained for a sufficiently long period of time to repair any malfunction.

If a malfunction occurs, valve 15 must retain its open position, valve 17 must close and valve 25 must open. Advisably, these valves are therefore equipped with electrical or electropneumatic actuating devices which are configured in such a manner that, upon a loss of current, valves 15 and 25 take on their open positions and valve 17 takes on its closed position. This results in reliable operation of the emergency cooling device, i.e., the additional condensation surface 23.

In the second embodiment of the invention for solving the present problem addressed, as shown in dashed lines, valve 25 likewise opens in case of a malfunction while valve 15 closes. Coolant 27 flows through conduit 24'' into additional condensation surface 23', evaporates there and is discharged to the atmosphere through conduit 32'. Thus, immediately after the occurrence of a malfunction, additional condensation surface 23' is caused to become sufficiently cold to maintain the vacuum in vacuum chamber 1. The product charge disposed therein is therefore not endangered.

In the third embodiment of the invention, as shown in dashed lines, valve 25 opens in case of a malfunction while valve 15 closes. Coolant 27 flows through conduit 24'' into additional condensation surface 23'', evaporates there and is discharged to the atmosphere through conduit 32''. As in the previous embodiments, additional condensation surface 23'' is caused to become sufficiently cold to maintain the vacuum in vacuum chamber 1 immediately after the occurrence of a malfunction, such that the product charge disposed therein is not endangered.

The present disclosure relates to the subject matter disclosed in European Patent Application No. 87110955.9, filed July 29th, 1987, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. A freeze drying apparatus, comprising:

a vacuum chamber;

an evacuation system comprised of a condenser and a vacuum pump connected by a conduit including a second valve, and a refrigeration machine, wherein the condenser has at least one condensation surface supplied by the refrigeration machine and wherein the condenser is connected to the vacuum chamber by a conduit including a third valve;

a reservoir container containing a coolant which is a liquid having a low boiling point; and an additional condensation surface which is connected to the reservoir container by a conduit including a first valve and which is disposed in the condenser.

2. The freeze drying apparatus according to claim 1, wherein the first valve, the second valve, and the third are equipped with electrical or electropneumatic actuating devices in such a manner that, upon a malfunction or loss of current, the second valve takes on its closed position and the first valve and the third valve take on their open positions or retain their open positions.

3. The freeze drying apparatus according to claim 1, wherein the reservoir container for the coolant has associated means for generating an increased pressure within the reservoir container.

4. The freeze drying apparatus according to claim 1, wherein the coolant in the reservoir container is liquid nitrogen.

5. A freeze drying apparatus, comprising:

a vacuum chamber;

an evacuation system comprised of a condenser and a vacuum pump connected by a conduit including a second valve, wherein the condenser is connected to the vacuum chamber by a conduit including a third valve;

a reservoir container containing a coolant which is a liquid having a low boiling point; and an additional condensation surface which is disposed in a chamber which is interconnected by a conduit to the vacuum chamber, and which is connected to the reservoir container by a conduit including a first valve.

6. A freeze drying apparatus, comprising:

a vacuum chamber;

an evacuation system comprised of a condenser and a vacuum pump connected by a conduit including a second valve, wherein the condenser is connected to the vacuum chamber by a conduit including a third valve;

a reservoir container containing a coolant which is a liquid having a low boiling point; and an additional condensation surface which is connected to the reservoir container by a conduit including a first valve, wherein the first valve and the third valve are equipped with electrical or electropneumatic actuating devices in such a manner that, upon a malfunction or loss of current, the first valve takes on its open position and the third valve takes on its closed position.

* * * * *